United States Patent [19]

Gettleman et al.

[11] 4,076,349

[45] Feb. 28, 1978

[54] MOBILE BEVERAGE DISPENSING CART

[75] Inventors: Ronald L. Gettleman, Framingham; Peter D. Stoner, Newton Centre, both of Mass.

[73] Assignee: Gettleman-Stoner, Inc., Newton Centre, Mass.

[21] Appl. No.: 807,427

[22] Filed: Jun. 17, 1977

[51] Int. Cl.[2] ..... A47B 77/08

[52] U.S. Cl. ..... 312/236; 312/250; 312/278

[58] Field of Search ..... 312/236, 250, 278

[56] References Cited

U.S. PATENT DOCUMENTS

| | | | |
|---|---|---|---|
| D. 154,578 | 7/1949 | Asaro | 312/278 |
| 1,513,357 | 10/1924 | Webber | 312/236 |
| 2,550,539 | 4/1951 | Earle | 312/278 |
| 2,845,780 | 8/1958 | Conklin et al. | 312/236 |
| 2,863,708 | 12/1958 | Cahn | 312/236 |
| 2,948,798 | 8/1960 | Ness | 312/236 |
| 3,275,393 | 9/1966 | Stentz et al. | 312/236 |
| 3,748,437 | 7/1973 | Keeshin et al. | 312/236 |
| 3,983,583 | 10/1976 | Herman et al. | 312/236 |

*Primary Examiner*—Paul R. Gilliam
*Assistant Examiner*—Victor N. Sakran
*Attorney, Agent, or Firm*—James J. Cannon, Jr.

[57] ABSTRACT

A mobile, self-contained beverage dispensing cart, characterized by a unitary rectangular-shaped cabinet structure, mounted on a plurality of swivel-type castors, and containing a plurality of internal and external non-communicating chambers for the storage of hot liquid beverages, and the liquid and gaseous components of the cold beverages to be dispensed therefrom. Said cart being designed for attendant-assisted or customer self-access from both longitudinal sides of said cart, the incorporated hot and cold beverage dispenser means are positioned in duplicate, one set being located on each longitudinal side of said cart. The serving temperatures of stored beverages contained within said cart are maintained at the desired levels by the use of non-electrical, thermally-insulated storage containers, and an ice supply storage means. The hot beverages are dispensed by gravity feed through manually-controlled spigots, whereas the cold carbonated beverages, are dispensed with the aid of pressure generated within the system by $CO_2$ stored in tanks incorporated within the cart's interior. Upper serving dispenser means are totally removable from the said apparatus for storage and cleaning purposes, and for converting said cart into a flat-surface mobile serving cart, or "stationary" bar.

8 Claims, 2 Drawing Figures

MOBILE BEVERAGE DISPENSING CART

BACKGROUND OF THE INVENTION

1. Field of the Invention

The present invention relates to a mobile, self-contained apparatus for the storage, dispensing and serving of both hot and cold liquid beverages. The apparatus comprises a unitary, essentially rectangular-shaped, housing having a plurality of both internal and external non-communicating, thermally-insulated chambers for the storage and dispensing of liquid beverages and their components. This apparatus also comprises the necessary heat-exchange control means for maintaining the stored beverages at the desired serving temperatures.

2. Description of the Prior Art

Portable and mobile self-contained beverage dispensing bars have heretofore been designed and employed primarily for use in offices, homes, railways, and airlines, and have therefore been of limited utility in commercial settings involving the serving of large numbers of people in a limited amount of time. Problems relating to maintenance of beverage temperature control of stored beverages on the prior art carts have not been adequately solved, resulting in short beverage storage periods, with the necessity of additional means needed for both heating and cooling of the stored liquids. It, therefore, has been the object of the present invention to overcome these, as well as other difficulties of the prior art. Further, the configurations of other prior art designs has led to a limited flexibility in function which has been further overcome by the convertibility features of the present invention.

The hotel, motel, restaurant and food service industries derive a significant portion of their sales by catering to conventions, conferences, meetings and similar functions, renting a function room to the participants and furnishing beverages at periodic intervals for a consideration. In such an environment, the time for serving beverages is very limited, regardless of the size of the group, most usually limited to a ten to fifteen minute "coffee break." The beverages must be brought into the room, served at the proper temperature in a short time period and then removed from the room. The usual beverages served are coffee, tea and soft drinks. It is industry practice to serve up to one hundred and fifty people these beverages in ten minutes from a single serving table.

From long experience in the industry, the inventors known that there is no commercially available dispensing and serving cart which can meet the industry's needs. A review of the prior patent art also reveals no serving cart which can meet these commercial requirements. At present the industry uses portable folding tables, table cloths, ice buckets and portable urns, and other miscellaneous items. The serving table and equipment are assembled prior to each serving and disassembled thereafter. The labor cost is high, and the equipment cost is high. Some components are discarded after a single use. No component has a useful life of more than three months. Hot beverages are kept warm by fuel sources which have an open flame, a constant fire hazard, as well as a continuing expense. Over the short useful life of a coffee urn, the cost of the fuel to keep the coffee warm will exceed the cost of the urn. The mobile beverage dispensing cart of the present invention is specifically designed to meet the requirements of the industry and eliminate the problems encountered in prior equipment. It is equiped to serve one hundred and fifty people in ten minutes with all beverages being served at the proper temperature. It uses no fuel source, and thus has no open flame and no fuel cost. Its cost is comparable to the present equipment costs, but it requires no assembly for each use. It is further designed to be durable to eliminate continuous replacement costs. It is completely self-contained and may be moved into and out of a function room very quickly.

SUMMARY OF THE INVENTION

The present invention comprises a mobile and convertible, self-contained, hot and cold beverage storage and dispensing cart, having a cabinet structure mounted on a plurality of swivel-type castors. Said cart contains a plurality of internal and external non-communicating, thermally-insulated chambers for the storage of both hot and cold liquid beverages, as well as the components, of such beverages, to be dispensed therefrom. The present invention is designed for simultaneous attendant-assisted or customer self-access from both the longitudinal sides of said cart.

To facilitate this dual mode of serving, the beverage dispensers and housing means are found positioned in duplicate, and in a back-to-back configuration, with one set of dispensers being positioned on each longitudinal side of said cart. The serving temperatures of the hot liquid beverages stored within said cart maintained at the desired levels (175° – 185° F), with the aid of incorporated non-electrical thermally-insulated storage containers. The hot beverages, such as coffee and tea, are dispensed by gravity-feed through manually-operated serving spigots, whereas the cold beverages, such as carbonated beverages, are manually dispensed by spigots with the aid of pressure generated within the system by $CO_2$ stored in a tank incorporated within the cart interior.

The top surface mounted cold beverage dispensing means, as well as the hot beverage storage and dispensing means, are readily and completely removable from the said cart for storage and cleaning purposes, as well as allowing the converting of said cart into a flat surface mobile serving cart or stationary bar.

The interior space of said cabinet is also readily accessible through incorporated doors on one side of said cart in order to replace the syrup or carbonic acid tanks which supply the cold beverages to be dispensed by said cart. Further, this results in easy access to the drain chamber incorporated within the said cabinet interior space.

DETAILED DESCRIPTION OF THE PREFERRED EMBODIMENT

Figure 1:
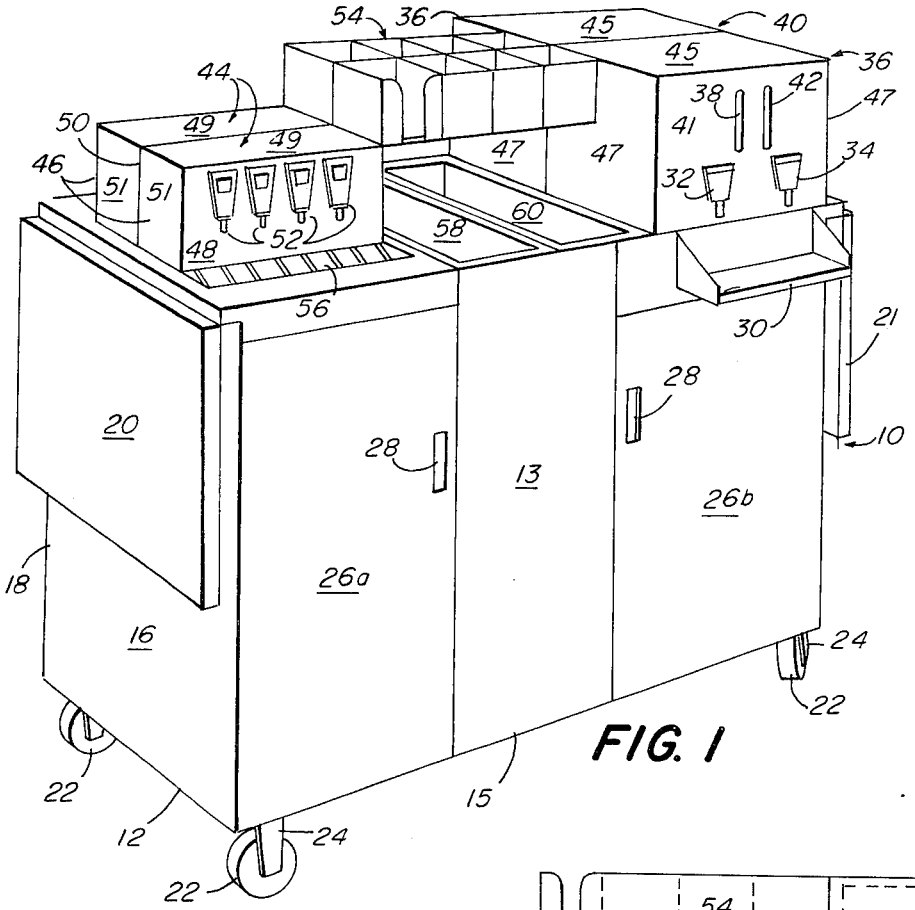
FIG. 1 is a perspective view of the mobile dispensing cart with the dual hot and cold beverage dispensing means in place.
Figure 2:
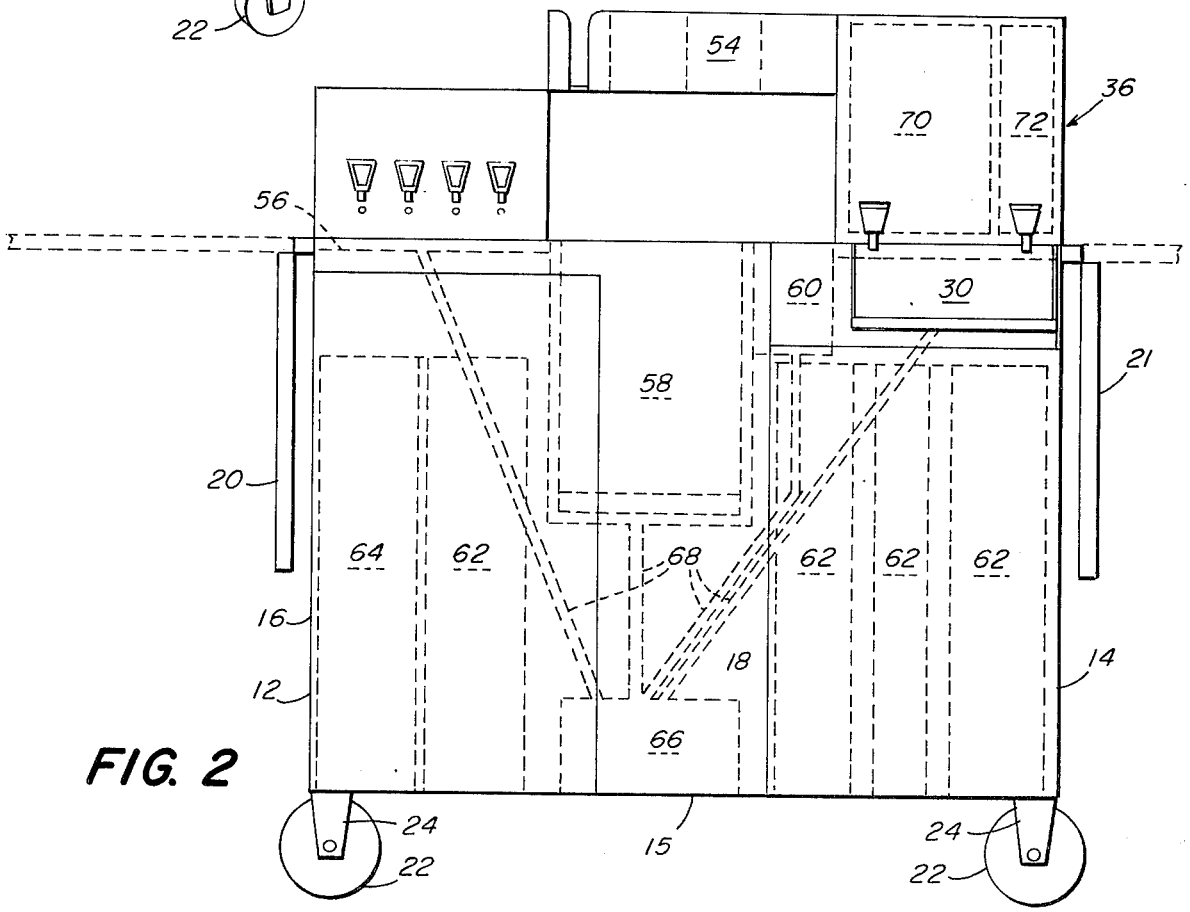
FIG. 2 is a cross-sectional view of the mobile dispensing cart taken on line 2 — 2 of FIG. 1 with removable dual dispensing means in place.

FIG. 1 is a perspective view of the mobile dispensing cart with the dual hot and cold beverage dispensing means in place. The mobile, self-contained, hot and cold beverage storage and dispensing cart of the present invention comprises a unitary rectangularly-shaped cabinet structure containing a plurality of internal and external non-communicating chambers for the storage of both hot and cold liquid beverages.

In FIG. 1, the mobile dispensing cart of the present invention with the dual beverage dispensing means in place is designated generally by the reference numeral 10. Cart 10 includes a substantially rectangular cabinet 12, having a front panel 13, a right end panel 14, a left end panel 16, a rear panel 18, a bottom panel 15, and two retractable hingably-mounted side shelves 20 and 21. Fully-rotatable swivel-type castors 22 are situated at each of the outer lower four corners of said cart housing 12, each castor being attached to said cart housing through a castor mounting bracket 24. Incorporated within the front panel 13 are two symmetrical front panel doors, 26*a* and 26*b*, situated respectively on the left and right sides of said front panel 13. Attached to the outer surface of each front panel doors 26*a* and 26*b*, is a recessed handle 28. Access to the interior storage space of said cart housing 12, is obtained by the opening outward and sidewards of doors 26*a* and 26*b*, with the aid of handles 28. Attached to the outer surfaces of the front panel 13 and rear panel 18, and located near the top of said panels 13 and 18, and placed directly below the hot liquid means 36 spigots 32 and 34, are fully retractable drain housings 30.

Situated removably on top of the cart housing 12, and located on the right side of the apparatus 10 are dual hot liquid storage and dispensing means 36. Dispensing means 36 consists of a rectangular housing 40, having both front 41 and rear 43 panels, as well as top 45 and side panels 47. Attached to the front panel 41 of means 36 are spigots 32 and 34, as well as the volume-indicating gauges 38 and 42, which indicate the remaining volumes stored within the hot liquid storage tanks. Within said housing 40 are two self-contained, non-communicating, thermally-insulated chambers. Chamber 70 is the larger of the two said chambers found within the hot liquid storage means 36, and contains the prepared hot coffee ready for dispensing. Chamber 72 also found located within means 36, and along side chamber 70, is for the storage of the hot water that is used in the preparation of several hot beverages such as tea, hot chocolate, and other hot beverages dispensed by the present apparatus.

Situated removably on top of the said cart housing 12, and located on the left side of the apparatus 10, are dual cold liquid dispensing means 44. Dispensing means 44 consists of a rectangular housing 46. Attached to the front panel 48, of said housing 46, are the cold beverage dispensing spigots 52. Four spigots 52 are horizontally mounted on the front panel 48 of the present embodiment. Underneath each set of said spigots 52, are located beverage drains 56.

Situated removably on top of the said cart housing 12, and located between the cold liquid means 44, and the hot liquid means 36, and displaced above the ice and cream chambers, is an open-topped, multi-chambered compartment housing known as the condiment means 54. This means 54 is designed for both the storage and dispensing of the condiments and accessories that are related to the primary function of said mobile dispensing cart.

It should be noted that the dual hot liquid storage and dispensing means 36, the dual cold liquid dispensing means 44, as well as the condiment means 54, are each completely and easily removable from the housing 12, for storage and cleaning of said means, as well as for the purpose of converting said cart housing 12 into a flat-surface serving cart or "bar," by then placing a flat surface on top of housing means 12.

Situated within the upper half of housing 12 and located centrally, and occupying the entire space between the front panel 13 and the rear panel 18, is a self-contained and thermally-insulated ice storage chamber 58. The top of said ice chamber 58 is uncovered and is accessible from both the front and rear of the cart 10 for purposes of ice serving. Located to the right of said ice chamber 58 is a smaller, similarly-shaped, self-contained and thermally-insulated cream service chamber 60. Similarly, the said cream chamber 60 is not covered and is also accessible from both the front and rear sides of the cart 10, for dual-sided customer access.

Situated within the remaining interior cabinet space of housing 12, is an array of self-contained and non-communicating cylindrical tanks for the storage of the syrup and carbonated water components of the cold liquid beverages that are dispensed by said cart 10. The present embodiment contains four syrup storage tanks 62, and one carbonic acid storage tank 64, tank 64 is placed on the far left side of the housing interior.

Also located within the said housing 12 is an enclosed plastic drain chamber 66. This drain chamber 66 is situated on the bottom panel 15 of said housing 12. Chamber 66 is a chamber connected to a series of plastic drain tubes 68, and is gravity-fed from the dual drains 30 and 56, as well as from the single liquid drains of chambers 58 and 60.

Shelves 20 and 21 are hingably attached to the top of side panels 14 and 16, by folding hinges on the undersurface of said shelves 20 and 21. The shelves are raised upwards and locked into a horizontal position with the use of said locking hinges. These shelves when in the horizontal position provide extra storage and serving space for the present invention. This feature relates closely to the inherent convertibility feature of this cart, which expands its use to a stationary cart or "bar".

The interior of said housing 12, is also readily accessible through the incorporated front doors 26*a* and 26*b*, in order to replace the syrup or carbonic acid tanks which supply the cold beverages that are dispensed by said cart 10. Further these doors 26*a* and 26*b*, allow easy access to the drain chamber 66 also incorporated within the said housing.

The combination of elements and subcomponents of the present apparatus has been designed and organized to assure rapid and efficient service of quality beverages to large numbers of people during a brief "coffee break."

It is also an important feature of the present invention that no electrical supply is necessary to activate the previously needed electrically means to maintain the stored beverages at the desired serving temperature. This temperature regulation is accomplished in the present invention by the utilization of the incorporated non-electrical thermal-insulating means which lines all the holding tanks and chambers of the present apparatus.

The present invention has the capacity to store hot liquid beverages at 180° F for a 4 hour period, within the incorporated holding tanks.

We claim:

1. A mobile, convertible, self-contained hot and cold beverage storage and dispensing cart comprising:

a rectangular unitary cabinet structure mounted on a plurality of castors;

said cabinet structure having two end panels, two parallel side panels substantially longer than said end panels forming front and rear panels, and a base panel;

a plurality of liquid dispensing units mounted along the top edges of said side and end panels, said dispensing units being mounted at each end of said cabinet structure and accessible for service from both front and rear side panels; the bases of said liquid dispensing units being partially recessed within said cabinet structure;

a plurality of recessed, thermally-insulated open cold storage chambers for storage of ice and cream; said open cold storage chambers being accessible from both front and rear sides of said cart and being centrally situated between said liquid dispensing units;

a condiment and supply rack mounted above said open cold storage chambers, accessible from both sides of said cart;

a storage compartment within said cabinet for storage of components of said liquid beverages;

drain means within said cabinet structure to receive spillage from said liquid beverage dispensing units;

doors mounted on said front side panel to provide access to the interior of said cabinet structure.

2. The cart of claim 1 further comprising:

retractable side shelves mounted to each end of said cabinet structure to expand the service surface area of said cart.

3. The cart of claim 1 wherein said liquid dispensing units further comprise:

two dispensing units for cold liquid beverages mounted back to back at one end of said cart such that one unit is accessible from each side;

each of said cold liquid dispensing units having a plurality of manually operated dispensing means, and a drain tray for spillage;

each of said cold liquid dispensing units being connected by hoses to supply tanks within said cabinet structure.

4. The cart of claim 1 wherein said liquid dispensing units further comprise:

two dispensing units for hot liquid beverages mounted back to back towards one end of said cart such that one unit is accessible from each side;

each of said hot liquid dispensing units having a plurality of manually operated dispensing means and a drain tray for spillage;

each of said hot liquid dispensing units having integral thermally insulated storage compartments to maintain said hot liquid beverages at proper serving temperatures for several hours;

each of said hot liquid dispensing units having drain means for spillage.

5. The cart of claim 1 wherein said liquid dispensing units, said open cold storage units and said condiment and supply unit are removable from said cart for cleaning.

6. The cart of claim 1 further comprising:

door means on said front side panel for access to the storage areas of said cabinet structure;

said door means having recessed handles.

7. The cart of claim 1 wherein the drain means of said hot liquid dispensing unit is a retractable tray which folds upward into said cabinet structure.

8. The cart of claim 1 wherein said open cold storage chambers are thermally insulated.

* * * * *